United States Patent [19]

Stevens

[11] 4,150,749

[45] Apr. 24, 1979

[54] ORE CONCENTRATOR TABLE SUPPORT

[76] Inventor: Walter W. Stevens, P.O. Box 476, Lebec, Calif. 93243

[21] Appl. No.: 871,210

[22] Filed: Jan. 23, 1978

[51] Int. Cl.[2] ..... B03B 5/06

[52] U.S. Cl. ..... 209/437; 209/446; 209/500; 209/508

[58] Field of Search ..... 209/66, 342, 412, 437, 209/442, 443, 445, 439, 441, 485, 488, 446, 477, 480, 481, 500, 503, 504, 423, 508; 137/883; 239/562

[56] References Cited

U.S. PATENT DOCUMENTS

| | | | |
|---|---|---|---|
| 594,287 | 11/1897 | Rouse | 209/443 |
| 641,720 | 1/1900 | Murphy | 209/441 |
| 686,088 | 11/1901 | Klein | 209/441 |
| 853,459 | 5/1907 | Isbell | 209/443 |
| 1,262,554 | 4/1918 | Patterson | 209/480 |
| 2,921,680 | 1/1960 | Kreta | 209/485 |
| 2,944,668 | 7/1960 | Stephan | 209/443 |
| 3,423,024 | 1/1969 | Morawetz | 137/883 |

*Primary Examiner*—Robert Halper
*Assistant Examiner*—Jon E. Hokanson
*Attorney, Agent, or Firm*—Max E. Shirk

[57] ABSTRACT

A riffled ore concentrating table of the reciprocating type is connected to a table support by ball bearings. The table support has one of its edges pivotably connected to one edge of a base member and the other of its edges supported by the other edge of the base member in a manner such that the elevation of one edge of the table may be adjusted with respect to the other edge of the table.

1 Claim, 8 Drawing Figures

ORE CONCENTRATOR TABLE SUPPORT

BACKGROUND OF THE INVENTION

The background of the invention will be set forth in two parts.

1. Field of the Invention

The present invention pertains generally to the field of ore concentrators and more particularly to a new and useful support for a riffled ore concentrating table of the reciprocating type.

2. Description of the Prior Art

Although applicant has not undertaken a prior art search, he is, nevertheless, familiar with one support for riffled ore concentrating tables of the reciprocating type. This support is in the form of springs which may be adjusted to tilt the table a predetermined amount about its major axis.

During reciprocation of tables supported by springs, a slight arc is imparted to the ore-supporting plane. This reduces the ore concentrating efficiency of the table and uses more power than does the table of the present invention.

SUMMARY OF THE INVENTION

It is a primary object of the present invention to provide a new and useful support for a riffled ore concentrating table of the reciprocating type not subject to the disadvantages enumerated above.

Two embodiments of the present invention are disclosed. Each embodiment includes a base having a rectangular frame defining a supporting surface including a pair of edges, a riffle table and means for supporting the riffle table on the edges of the base. The support means comprises (1) a support member having first and second edges; (2) a pair of hinges swingably connecting one of the edges on the support member to one of the edges on the base; (3) adjusting screws supporting the other edges on the support member on the other edge of the base in a manner such that the other edge of the support member may be supported by the base at elevations exceeding the elevation of said one edge on the support member for tilting the riffle table about its longitudinal axis; and (4) spherical members reciprocably coupling the riffle table to the support member in a manner such that the edges of the riffle table will remain parallel to the edges of the support member during reciprocation of the riffle table.

In one embodiment, the support member is a rectangular frame overlying the rectangular frame on the base. In a second embodiment, which is presently considered to be the best mode of putting the invention to practical use, the support member comprises a pair of beams. One is placed across the base near the front of the riffle table and one is placed across the base near the rear of the riffle table.

Each embodiment also includes an adjustable chain and spring arrangement for fine-tuning the reciprocating stroke and an improved water distribution system. The water distribution system includes an inlet pipe having adjustable outlet apertures extending along an upstanding wall on the riffle table. This upstanding wall extends upwardly and outwardly at a suitable angle with respect to the floor of the table. One suitable angle has been found to be 135 degrees.

The features of the present invention which are believed to be novel are set forth with particularity in the appended claims. The present invention, both as to its organization and manner of operation, together with further objects and advantages thereof, may best be understood by making reference to the following description, taken in connection with the accompanying drawings in which like reference characters refer to like elements in the several views.

DESCRIPTION OF THE PREFERRED EMBODIMENTS

Figures 1, 2, 3:
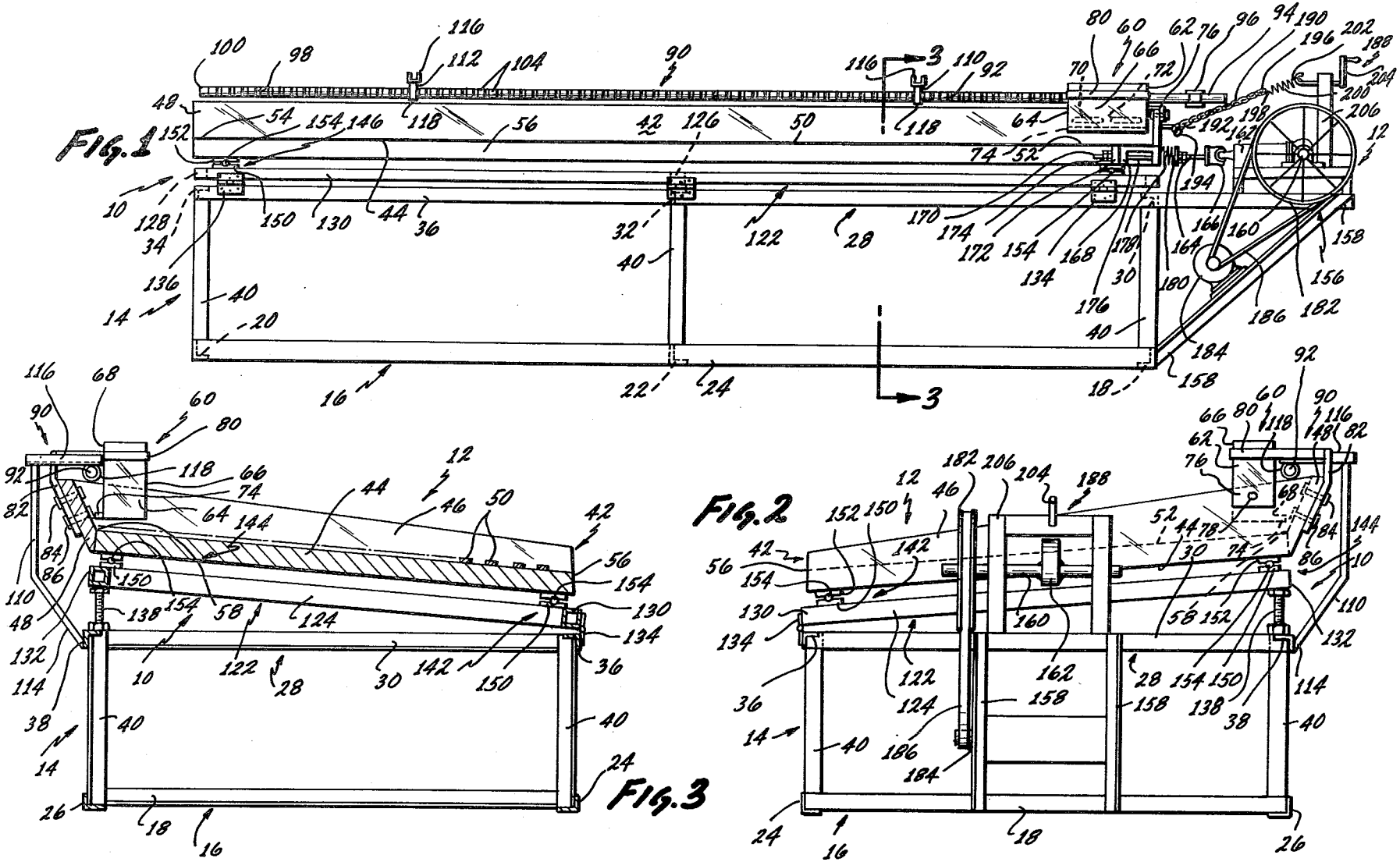
FIG. 1 is a right side elevational view of an ore concentrator employing a first embodiment of the present invention.
FIG. 2 is a front elevational view of the concentrator of FIG. 1.
FIG. 3 is a cross-sectional view taken along line 3—3 of FIG. 1.

Referring again to the drawings and more particularly to FIGS. 1–4, a support member constituting a first embodiment of the present invention, generally designated 10, is shown in combination with an ore concentrator 12.

Ore concentrator 12 comprises a base member 14 including a lower frame 16 having front, rear and intermediate cross rails 18, 20, 22, respectively, and right and left side rails 24,26, respectively. Base member 14, which may be fabricated from steel angle iron, also includes an upper frame 28 having front, intermediate and rear cross rails 30, 32, 34, respectively, and right and left side rails 36,38, respectively. Frames 16, 28 may be connected together by suitable upstanding angle iron members, like the ones shown at 40.

Figure 4:
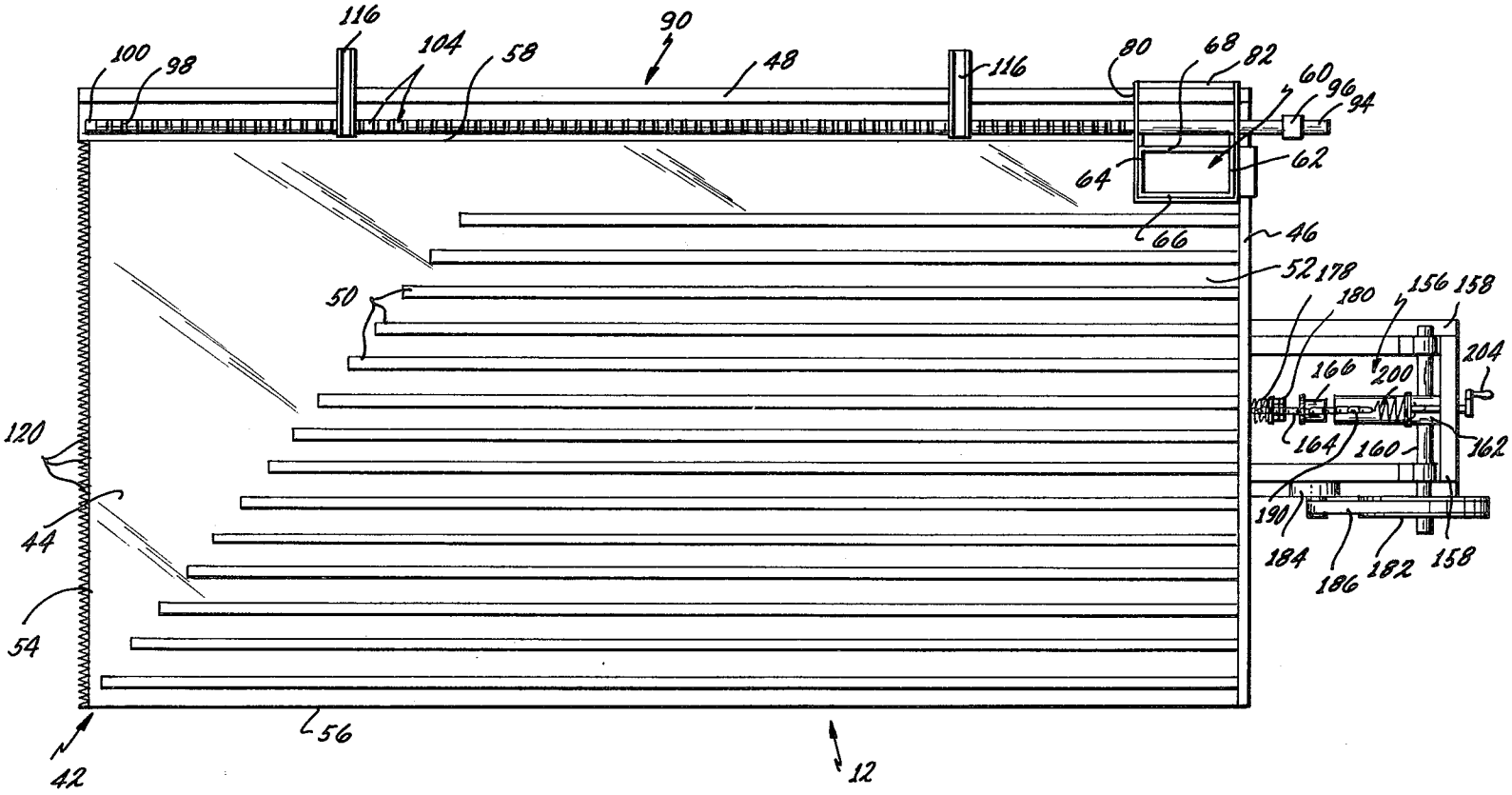
FIG. 4 is a plan view of the concentrator of FIG. 1.

Ore concentrator 12 includes a riffle table 42, which is preferably molded from fibre glass, having a floor 44, a front wall 46 and a left sidewall 48. A plurality of riffles 50 may be provided on floor 44 in parallel, spaced-apart relation, as best shown in FIG. 4. Each riffle 50 may be about ⅜ inch high at the front or feed end 52 of table 42 and about 0 inch high adjacent the rear or discharge end 54 of table 42. Riffles 50 become progressively shorter at discharge end 54 as they progress laterally from the right edge 56 of table 42 to its left edge 58, where left sidewall 48 extends upwardly and outwardly from floor 44 forming an angle of about 135 degrees therewith.

Ore concentrator 12 also includes an ore feeder 60 having a front wall 62, a rear wall 64, a right sidewall 66 and a left sidewall 68. Sidewall 68 is provided with a pair of elongated ore-discharge openings 70, 72 beneath which is mounted an ore-discharge lip 74 for spreading discharged ore onto left sidewall 48 of table 42 adjacent edge 58.

Ore feeder 60 may be affixed to table 42 by a first bracket 76, which may be affixed to front wall 46 by suitable fasteners, like the one shown at 78, and by a second bracket 80, which encompasses feeder 60 and includes a leg 82 affixed to sidewall 48 by a pair of fasteners 84, 86.

Figure 6:
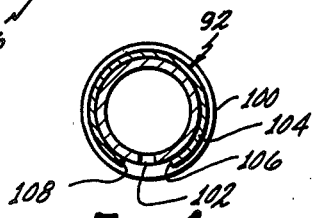
FIG. 6 is a cross-sectional view taken along line 6—6 of FIG. 5.
Figure 5:
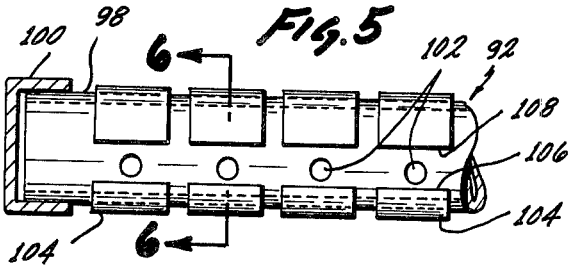
FIG. 5 is an enlarged, partial elevational view, with parts shown in cross section, of the water inlet pipe on the concentrator of FIG. 1.

Concentrator 12 also comprises a water distribution system 90 including a conduit 92 having an inlet end 94, through which the flow of water is controlled by an inlet valve 96, and a capped end 98, which is closed by a cap 100 (FIG. 5). As best seen in FIG. 5 and 6, conduit 92 is provided with a plurality of water-outlet apertures 102 spaced uniformly along conduit 92 from the front end 52 of table 42 to the rear end 54 thereof. Discharge of water through each aperture 102 may be controlled by a band 104 which may be made from a polymeric material and which has a radius-of-curvature with respect to the radius-of-curvature of conduit 92 such that each band will girp conduit 92 with sufficient force to retain each band in different rotated positions, whereby an associated aperture 102 may be partially closed by either the leading edge 106 or the trailing edge 108 of an associated band 104. Conduit 92 may be affixed to base member 14 by a pair of brackets 110, 112 each having a lower end 114 secured to base member 14 and an upper end 116 to which conduit 92 is attached by a clamp 118. Each end 116 is positioned above edge 58. As will be more fully described hereinafter, support member 10 supports table 42 with a predetermine tilt about its longitudinal or major axis with its left edge 58 higher than its right edge 56 so that water discharging from apertures 102 will engage sidewall 48 and proceed uniformly across table 42 from its left edge 58 to its right edge 56. Additionally, the feed end 52 of table 42 is higher than its discharge end 54 so that the water will also proceed uniformly to discharge end 54 where a plurality of notches 120 are provided. It may be noted at this point that the upward and outward slope on sidewall 48 minimizes aeration of the water and helps distribute the water uniformly in any given area of table 42.

Support member 10 includes a frame 122 having a front cross rail 124, an intermediate cross rail 126, a rear cross rail 128, a right side rail 130 and a left side rail 132. Frame 122 corresponds in size and shape to upper frame portion 28 of base member 14 which defines a supporting surface having right side rail 36 for one edge and left side rail 38 for another edge. The right side rail portion 130 defines a first edge of frame 122 and the left rail 132 defines a second edge thereof. Thus, support member 10 may have a first edge 130 and a second edge 132. Edge 130 is swingably connected to edge 36 on supporting surface 28 by a pair of hinges 134, 136 and edge 132 is adjustably supported above edge 38 of supporting surface 28 by a pair of adjusting screws 138, 140, which may be adjusted to tilt table 42 a predetermined amount about its major axis.

Support member 10 also includes four coupling members 142, 144, 146, 148 reciprocably coupling table 42 to frame 122. The coupling members 142, 144, 146, 148 each includes a lower race 150, which is affixed to frame 122, an upper 152, which is affixed to table 42, and a spherical member or ball 154, which is captured between races 150, 152.

Table 42 may be reciprocated by a drive assembly 156 supported on base member 14 by suitable angle-iron members, like the ones shown at 158. Drive assembly 156 includes a crank 160 which reciprocates a coupling 162 articulately coupled to a long bolt 164 by a U-joint 166. Bolt 164 passess through a heavy steel channel member 168 affixed to table 42 and includes a free end 170 which carries a steel plate 172 and an adjusting nut 174. Bolt 164 also includes an intermediate portion 176 which carries a compression spring 178 and an adjusting nut 180 upstream of channel 168. Crank 160 is rotated by a pulley 182 connected to an electric motor 184 by a belt 186. Nuts 174, 180 may be manipulated to adjust the reciprocating stroke imparted to table 42 by drive assembly 156. This stroke may be further adjusted by a fine tuning device 188 including a chain 190 having a first end 192 connected to front table wall 46 by J-shaped bolt 194 and a second end 196 connected to a first end 198 of a spring 200 the second end 202 of which is connected to an adjusting crank 204 rotatably mounted in a frame 206. Crank 204 may be manipulated to tension chain 190 and spring 200 for smoothing out the stroke imparted to table 42.

Figure 7:
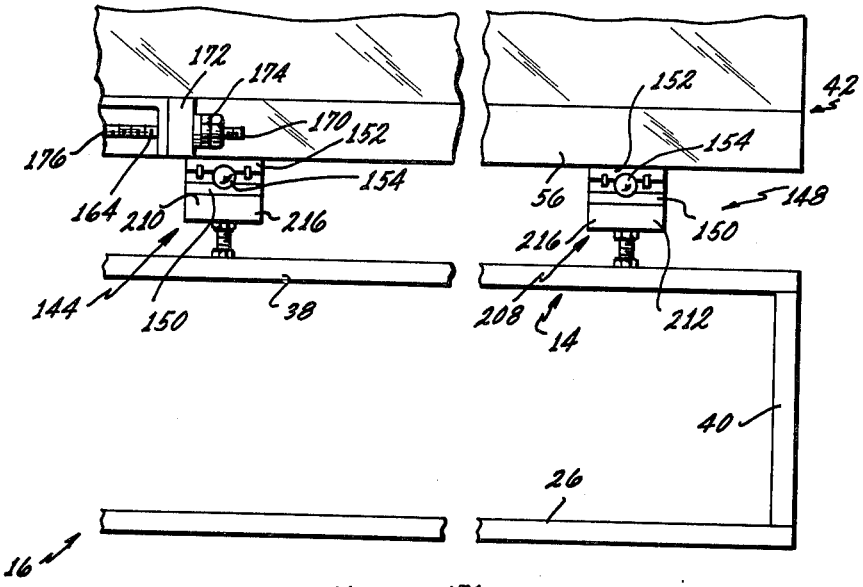
FIG. 7 is a partial left elevational view of an ore concentrator employing a support member constituting a second embodiment of the present invention.
Figure 8:
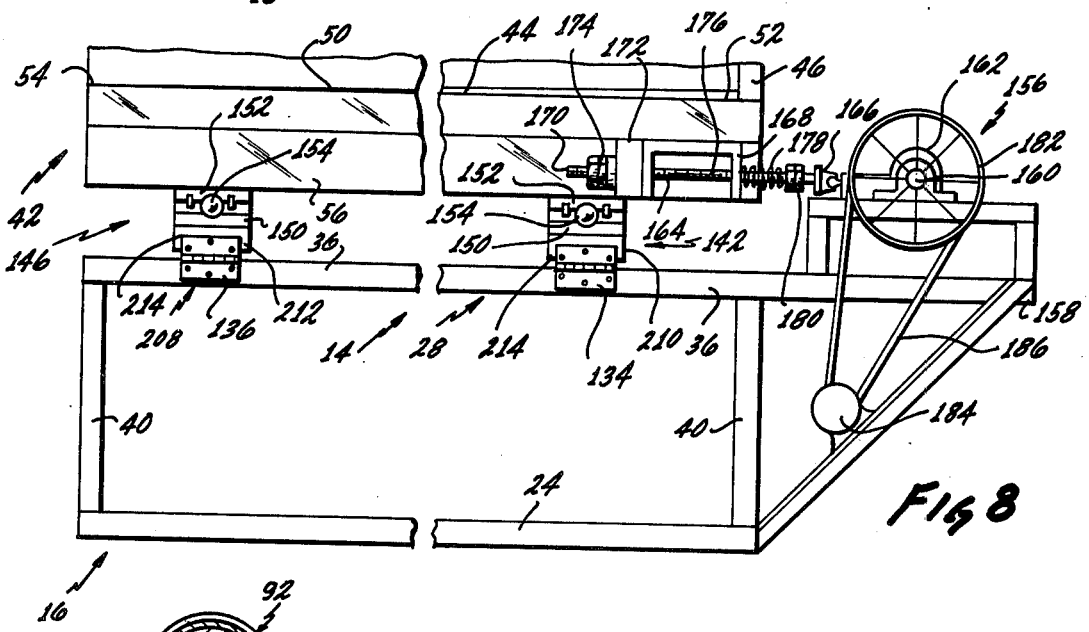
FIG. 8 is a partial right elevational view of the device of FIG. 7.

Referring now to FIGS. 7 and 8, a support member constituting a second embodiment of the present invention and currently considered to be the best mode of carring out the invention, generally designated 208, includes a pair of cross beams 210, 212 which replace frame 122 of the first embodiment. Cross beam 210 supports the front of table 42 and cross beam 212 supports the rear portion of table 42. A first edge 214 of each beam may be swingably connected to one edge 36 of base member 14 and a second edge 216 may be adjustably supported above the other edge 38 of base member 14. Hinges 134,136 and adjusting screws 138, 140 may be used for these purposes, respectively, if desired. Additionally, coupling members 142, 144, 146 and 148 may be used to couple table 42 to beams 210, 212 and drive assembly 156 may be used to reciprocate table 42.

What is claimed is:

1. An ore concentrator, comprising:

a base having a major axis;

a riffle table including a floor, a front wall, a side wall extending upwardly and outwardly from said floor and forming an angle of approximately 135 degrees therewith and a discharge end, said floor having a plurality of riffles provided thereon in parallel, spaced-apart relation;

a pair of support members each having first and second edge portions;

a hinge swingably connecting one of said edge portions of each of said support members to said base in spaced-apart relation along a line parallel to its major axis;

a threaded member adjustably supporting the other of said edge portions of each of said support members on said base in a manner such that said other edge portions of said support members may be supported by said base at elevations exceeding the elevation of each of said one edge portions of said support members;

a plurality of ball bearings reciprocably coupling said riffle table to said edge portions of said support members in a manner such that the longitudinal edge portions of said riffle table will remain parallel to said first and second edge portions of said support members during reciprocation of said riffle table regardless of the amount of inclination imparted to said riffle table about its major axis by said threaded members; and a stationary water distribution system including a conduit solely supported by said base adjacent said side wall in a position such that water discharging from said conduit will flow down said side wall and onto said floor, said conduit being provided with a plurality of water-outlet apertures spaced uniformly along said conduit from said front wall to said discharge end of said table, said water distribution system also including an arcuate band frictionally engaging said conduit over each aperture, each of said bands including an edge portion adapted to regulate flow of water through its associated aperture when rotated to a predetermined position on said conduit.

* * * * *